US005871585A

United States Patent [19]

Most et al.

[11] Patent Number: 5,871,585

[45] Date of Patent: Feb. 16, 1999

[54] APPARATUS FOR APPLYING A FLUID TO A MOVING WEB OF MATERIAL

[75] Inventors: Ronald W. Most, River Falls, Wis.; Terrence E. Cooprider, Woodbury, Minn.

[73] Assignee: Minnesota Mining and Maufacturing Company, Saint Paul, Minn.

[21] Appl. No.: 619,043

[22] Filed: Mar. 20, 1996

[51] Int. Cl.[6] ..... B05C 3/02

[52] U.S. Cl. ..... 118/410; 118/407; 118/419; 118/423; 118/428; 118/429; 118/DIG. 18; 425/462; 425/130

[58] Field of Search ..... 118/407, 410, 118/419, 423, 428, 429, DIG. 18; 425/462, 130

[56] References Cited

U.S. PATENT DOCUMENTS

| | | | |
|---|---|---|---|
| 3,899,999 | 8/1975 | Christ et al. | 118/405 |
| 4,051,807 | 10/1977 | Graf et al. | 118/410 |
| 4,550,681 | 11/1985 | Zimmer et al. | 118/410 |
| 4,675,208 | 6/1987 | Kageyama et al. | 118/410 |
| 4,708,629 | 11/1987 | Kasamatsu | 118/410 |
| 5,186,754 | 2/1993 | Umemura et al. | 118/419 |
| 5,294,258 | 3/1994 | Jarrell et al. | 118/410 |
| 5,320,679 | 6/1994 | Derezinski et al. | 118/410 |
| 5,601,647 | 2/1997 | Petzsch | 118/419 |

FOREIGN PATENT DOCUMENTS

| | | | |
|---|---|---|---|
| 605080 | 7/1994 | European Pat. Off. | B05C 5/02 |
| 8907752 | 10/1990 | Germany | B05B 1/04 |
| 4010262 | 10/1991 | Germany | B05C 5/02 |

*Primary Examiner*—Peter Chin
*Assistant Examiner*—Michael P. Colaianni
*Attorney, Agent, or Firm*—Michaele A. Hakamaki

[57] ABSTRACT

An apparatus that comprises a body including a reservoir adapted for receiving a quantity of fluid and a plurality of fluid distribution channels each having a length and a cross-sectional area and being in fluid communication with and extending from the reservoir from a first end and terminating at a second, distal end in an orifice. The apparatus further comprises a distribution chamber in the body for commonly receiving the fluid exiting each of the orifices, for merging the fluid exiting each of the orifices into at least one continuous coating stream, and for equalizing the pressure of the fluid, the distribution chamber having a first side in fluid communication with the plurality of fluid distribution channels and a second side that is open to allow the fluid to exit the body for uniform distribution onto the web. In addition, the apparatus comprises a smoothing surface on the body adjacent the second side of the distribution chamber to smooth the fluid on the moving web as the fluid exits the second side of the distribution chamber and is deposited on the moving web and a fluid supply means for supplying fluid to the reservoir and for maintaining the fluid under pressure in the reservoir, whereby the fluid moves under pressure from the reservoir through the fluid distribution channels to the first side of the distribution chamber, through the distribution chamber to exit the second side of the distribution chamber, and onto the moving web.

43 Claims, 6 Drawing Sheets

APPARATUS FOR APPLYING A FLUID TO A MOVING WEB OF MATERIAL

TECHNICAL FIELD

The present invention relates to an apparatus and method for applying a fluid to a substrate. More particularly, the present invention provides an applicator for use in coating application systems for applying a fluid to a moving web of material.

BACKGROUND OF THE INVENTION

The two basic categories of coating application systems are excess coat and wipe systems and pre-metered systems, which differ in their method of controlling the amount of coating solution applied to a substrate. In excess coating application systems, an amount of solution in excess of the desired coating weight is applied to the substrate. A scraping device then removes the excess coating material from the substrate to achieve the desired coating weight. In a pre-metered application system, the amount of coating material is accurately measured and initially applied to the substrate to achieve the desired coating weight and does not require the removal of excess coating material.

Excess coating application systems can apply coating material to the substrate by a number of different techniques. For example, the substrate may be fed through a trough containing the coating solution so that the entire substrate is immersed in the coating solution. When the substrate exits the trough, a pair of rotating rollers are spaced appropriately from each other to wipe the excess coating material from the substrate. This removed coating material is typically recirculated into the system for return to the coating trough. For another example, blade or gap methods may be used, where a thick solution is allowed to flow through an adjustable opening directly onto a substrate, after which the excess solution is removed from the substrate surface. Other examples include dripping or forcing the coating solution onto the substrate, spraying the solution onto the substrate, and pressure or extrusion coating the solution onto the substrate. In any of these systems, devices such as knives, blades, rods, or rollers are used to remove the excess material that has been deposited onto the substrate, and the excess material is typically recirculated into the coating application system. Although excess coating application systems are useful for many types of substrates and coating materials, pre-metered coating application systems may be more desirable for certain types of coating solutions, coating weights, and substrates.

Pre-metered coating application systems include various types of coating equipment. In these systems;, knives or blades are typically used for smoothing a metered amount of coating material after it is applied to the substrate surface. In addition, these systems typically do not provide for recirculation of the coating solution since none of the solution applied to the substrate is removed from the substrate surface. Various slot coater configurations are described in references such as *Coating and Laminating Machines* (H. L. Weiss, Converting Technology Company 1977), which discusses different methods of foaming polymeric materials. One particular system for applying fluid to substrates includes a slot orifice coater, which is a coater that extrudes a solution through a gap and applies that extruded solution directly from the gap onto a moving substrate. In order to achieve a uniform distribution of fluid across the width of the substrate, it is necessary for the pressure within the coater to be relatively constant across the width of the coater.

Therefore, slot coaters of this type are typically used with fluids having high viscosities and fluids being coated at high coating weights. Under these conditions, it is relatively easy to maintain uniform coating across the web. When these coaters are used with lower viscosity fluids and/or lower coating weights, it becomes more difficult to maintain uniform flow velocity and uniform hydrostatic pressure across the width of the slot.

In some slot coaters, the hydrostatic pressure of the fluid within the coater can actually build to the point where some portions of the coater will deflect and deform relative to other portions of the coater. If this happens, the slot height can vary across the width of the coater, thereby causing a nonuniform distribution of fluid to be coated onto the substrate. In order to achieve more uniform coatings, some slot coaters are thus provided with a choker bar or resistor bar assembly mounted outside the slot, which is a movable assembly that can be adjusted to change the gap height across the width of the coater. However, in order to accommodate the addition of an adjustment bar assembly, coaters with adjustment bar assemblies typically must be larger, sturdier, and consequently more costly and significantly more heavy and difficult to handle than a coater without an adjustment bar assembly. In addition, although these coater bars can correct some of the gap variations caused by high pressure, proper adjustment of the choker bar or resistor bar can typically only be accomplished by an operator who has considerable skill and experience adjusting the gap for a particular slot coater. To measure or monitor the effects of these adjustments, additional on-line measuring devices may also be required, which can be costly.

One method used to eliminate the requirements of gap adjustment is with a coating die known as a round multiple orifice (RMO) die of the type described in U.S. Pat. Nos. 4,391,856 (McIntyre et al.) and 5,264,036 (Hoechst et al.). An RMO die typically has a central reservoir from which multiple liquid nozzles extend. These nozzles terminate at the surface of the substrate so that the fluid is forced through the reservoir and nozzles, depositing the fluid directly onto the substrate surface in a series of fluid beads. A shear surface is oriented adjacent to the exit of these nozzles to merge the series of fluid beads together after the fluid is deposited onto the substrate. However, several parameters effect the uniformity of the merging of fluid beads across the substrate, such as the nozzle size, nozzle spacing, fluid viscosity, fluid quantity, and substrate porosity. As these parameters change, it can become more difficult for the shear surface to merge the beads together and the fluid will be coated onto the substrate in distinct stripes, rather than a continuous coating layer. For example, it is more likely that beads of high viscosity fluids will result in stripes along the length of the web than with beads of low viscosity fluids. However, as with the slot coaters, when RMO dies are used with lower viscosity fluids or lower coating weights, it becomes difficult to maintain uniform flow velocity and uniform pressure across the width of the die. Again, this problem is further emphasized when the width of the coater is increased.

SUMMARY OF THE INVENTION

In one aspect of this invention an apparatus is provided for applying a fluid to a moving web of material, wherein the apparatus comprises a body including a reservoir adapted for receiving a quantity of the fluid and a plurality of fluid distribution channels each having a length and a cross-sectional area and being in fluid communication with and extending from the reservoir from a first, proximate end and terminating at a second, distal end in an orifice. The apparatus further comprises a distribution chamber in the body adapted for commonly receiving the fluid exiting each of the orifices, adapted for merging the fluid exiting each of the orifices into at least one continuous coating stream, and adapted for equalizing the pressure of the fluid, the distribution chamber having a first side and a second side, wherein the first side is in fluid communication with the plurality of fluid distribution channels and the second side is open to allow the fluid to exit the body for uniform distribution onto the web. In addition, the apparatus comprises a smoothing surface on the body adjacent the second side of the distribution chamber adapted to smooth the fluid on the moving web as the fluid exits the second side of the distribution chamber and is deposited on the moving web and a fluid supply means adapted for supplying fluid to the reservoir and adapted for maintaining the fluid under pressure in the reservoir, whereby the fluid moves under pressure from the reservoir through the fluid distribution channels to the first side of the distribution chamber, through the distribution chamber to exit the second side of the distribution chamber, and onto the moving web.

Also provided is a method of applying fluid to a moving web of material. The method includes the steps of (a) providing a distribution chamber having a volume, (b) providing a quantity of fluid, (c) pressurizing the fluid, (d) conveying the fluid in separate streams at substantially the same flow rates and pressures to the distribution chamber, (e) merging the streams of fluid in the distribution chamber into a continuous stream of fluid, (f) ejecting the continuous stream of fluid from one side of the distribution chamber, (g) depositing the fluid exiting the distribution chamber onto the moving web of material, and (h) smoothing the fluid onto the web.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

The present invention generally relates to an apparatus and method for pre-metered coating of fluids on a moving substrate, such as a web of material. More specifically, the present invention provides a coating apparatus capable of coating a wide range of coating weights and fluid viscosities in a smooth coating layer with uniform cross-web fluid distribution.

The present invention may be used with various types of fluids, for example, water-based coatings, adhesive coatings, organic solvent-based coatings, hot-melt materials, or mixtures thereof. Suitable fluids may be provided at various temperatures and fluid viscosities, depending on the particular application.

Figure 1:
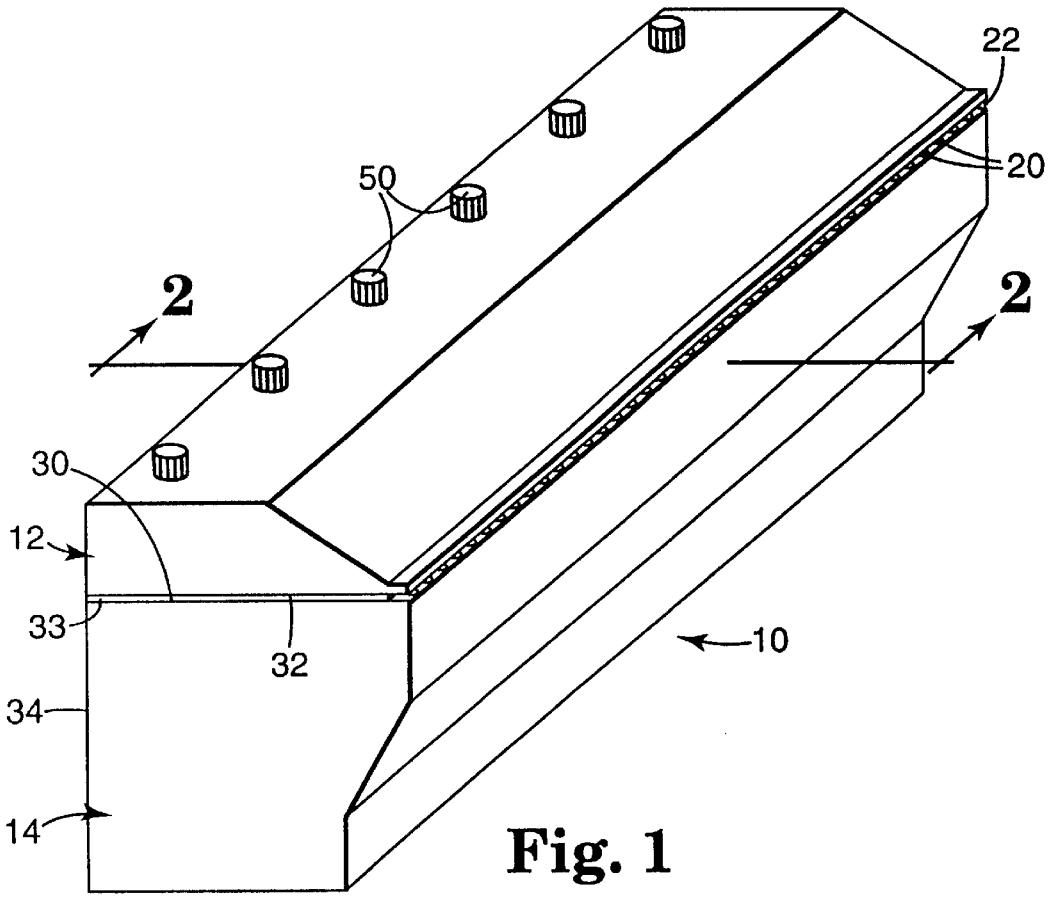
FIG. 1 is a perspective view of one embodiment of a coating apparatus of the present invention.
Figure 2:
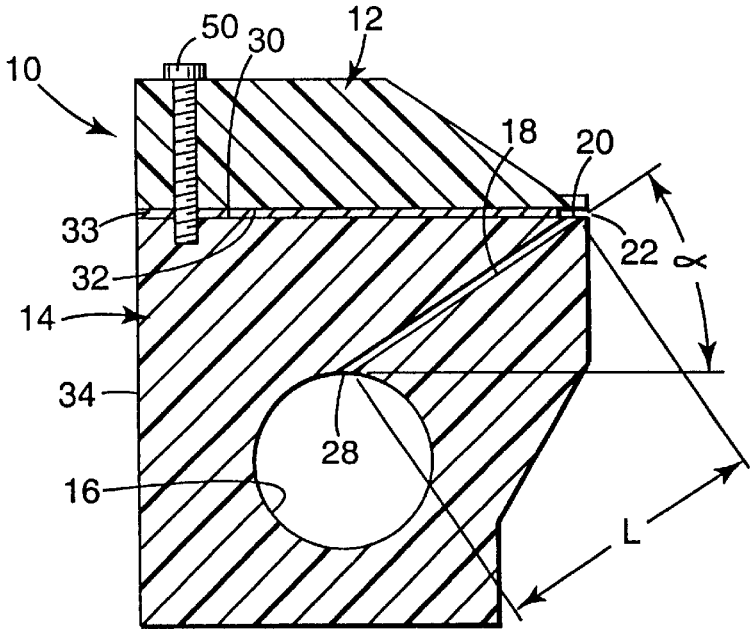
FIG. 2 is a cross-sectional view of a coating apparatus taken along line 2—2 of FIG. 1.
Figure 2A:
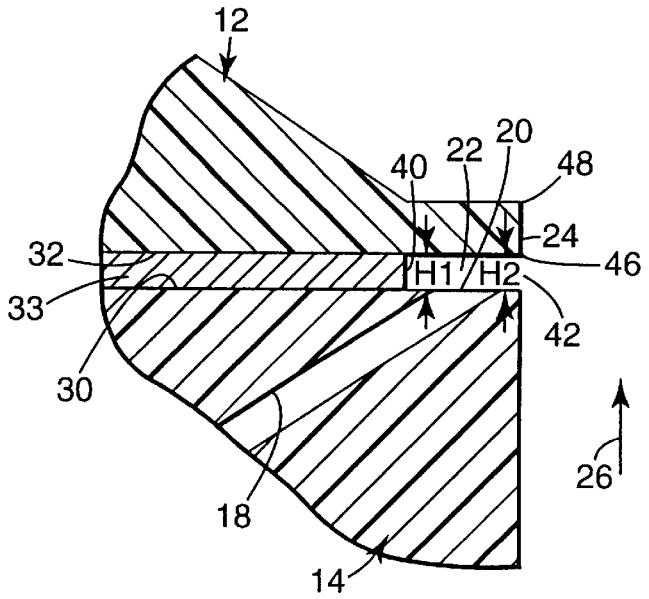
FIG. 2*a* is an enlarged cross-sectional view of a portion of the coating apparatus of FIG. 2.

Referring now to the Figures, wherein the components are labeled with like numerals throughout the several Figures, and initially to FIGS. 1, 2, and 2*a*, a coating apparatus or die 10 is illustrated. The basic components of the coating die 10 comprise a top body portion 12 and a bottom body portion 14. The bottom body portion 14 has an internal reservoir 16 into which fluid enters the coating die. The reservoir 16 has a plurality of distribution channels or nozzles 18 along the length of the reservoir 16 and extending therefrom at an angle a in a generally upward direction. Each channel terminates at an orifice opening 20, where the orifice openings 20 are typically aligned in a row along the longitudinal direction of the coating die. The row of orifice openings 20 are positioned so that the fluid exiting the channels 18 exit into a distribution chamber 22. The fluid merges together into a substantially continuous body of fluid within the chamber 22 and moves toward a smoothing surface 24 of the top body portion 14. The fluid then exits the chamber 22 adjacent the smoothing surface 24 onto the surface of a material moving generally parallel to the smoothing surface 24 in a direction 26.

The reservoir 16 is typically cylindrical for ease in manufacturing and to facilitate easy reservoir cleaning. Alternatively, the reservoir 16 may be a rectangular chamber into which the fluid may be supplied into one of the ends or into the bottom of the chamber. However, the reservoir may instead be oval, triangular, pentagonal, or have another shape in cross-section, as is found to be advantageous. The fluid may be supplied to the reservoir 16 such as by a pump, may be gravity-fed, or may rely on other known methods of supplying quantities of fluid to a coating die. In addition, the fluid may be supplied to the reservoir 16 at one or both ends, or to some intermediate point along the length of the reservoir 16.

Each distribution channel 18 has a first end 28 and a second end or orifice 20, where a length L of each channel 18 is equal to the distance between the first end 28 and orifice 20. The first end 28 opens to or is in fluid communication with the reservoir 16 so that fluid can exit the reservoir 16 into the first end 28 of each channel 18. Each channel 18 is preferably spaced from and generally parallel to each adjacent channel 18. More specifically, each channel 18 preferably has the same length L and extends at the same angle a from the reservoir 16. However, it is understood that some of the channels 18 may have a different length L than other channels 18 and that the channels may extend at different angles a from the reservoir 16. In one preferred embodiment, each channel 18 extends at the same angle $\alpha$, where the angle $\alpha$ is between 0 and 90 degrees. However, it is most preferable that the angle $\alpha$ is between 30 and 60 degrees.

When the individual distribution channels or nozzles 18 are the same length L and extend at the same angle $\alpha$ from the same general position on the circumference of the reservoir 16, the orifice openings 20 will generally be aligned in a single row. It is understood that when the length L or extension angles $\alpha$ of the channels 18 are different, the orifice openings 20 may not be aligned in a single row, but may be in a staggered or random arrangement along the length of the reservoir 16.

The orifice openings 20 are preferably round, but may be another suitable shape, such as oval, triangular, pentagonal, or the like. It is also preferable that the channels 18 have the same cross-sectional shape and size from the first end 28 to the orifice opening 20. However, the shape and size of each channel 18 may vary along its length L (e.g., the cross-sectional area of each channel may be tapered to either increase or decrease along its length L). When the channels 18 are circular in cross-section, the diameter of the channels 18 and their corresponding orifice openings 20 preferably range from 0.10 cm (40 mils) to 0.15 cm (60 mils). Although the channels and orifices may be smaller than 0.10 cm (40 mils) in diameter, the channels may become more difficult to clean and more susceptible to clogging at smaller diameters. The channels and orifices may also be larger than 0.15 cm (60 mils) in diameter, however, it may be more difficult for the fluid streams to merge into a uniform, continuous layer as the channels and orifices become larger. Moreover, it is easier for the fluids to merge into a uniform continuous layer when each channel is relatively close to each adjacent channel than when adjacent channels are spaced further from each other.

In addition, the cross-sectional area of each of the orifice openings 20 when viewed from above the bottom body portion 14 is typically considerably smaller than the cross-sectional area of the reservoir 16 when viewed from the side of the die 10 (as shown in FIG. 2). For one example, the cross-sectional area of the reservoir 16 is approximately 2.84 square centimeters (0.44 square inches), where the cross-sectional area of each of the orifice openings 20 is approximately 0.013 square centimeters (0.002 square inches).

When the reservoir 16 is circular in cross-section, the channels 18 preferably extend from the top half of the circumference of the reservoir 16 and more preferably extend from the highest point of the reservoir 16, as illustrated in FIG. 2, to allow any air that becomes entrapped within the reservoir to be expelled from the reservoir. If the reservoir 16 is a shape other than circular, the channels 18 preferably extend from the upper half of the periphery of the reservoir, and more preferably extend from the highest point along the periphery of the reservoir 16. By allowing the air to be expelled from the reservoir 16, formation of air bubbles in the fluid is minimized.

As best illustrated in FIG. 2, the bottom body portion 14 has a top face 30 and the top body portion 12 has a bottom face 32, wherein the top face 30 and the bottom face 32 are positioned to face each other when the die 10 is assembled. It is preferable that the faces 30 and 32 are planar across their surfaces such that there will be no significant gaps between the faces if they are brought in contact with each other. In one preferred embodiment, the distribution chamber 22 is formed by inserting a gap spacing device 33, or shim, between the top body portion 12 and the bottom body portion 14. The shim 33 is preferably designed so that when it is positioned between the top and bottom body portions 12, 14, no fluid can seep between the shim 33 and either the top body portion 12 or the bottom body portion 14. In other words, the shim 33 is preferably a fluid-tight spacing device positioned between the top and bottom body portions 12, 14. In this embodiment, the shim 33 is a planar piece of material having a thickness equal to the desired height of the chamber 22. The shim 33 preferably extends from the back side 34 of the die 10 toward the smoothing surface 24, and may extend to the smoothing surface 24. The area created between the shim 33 and the smoothing surface 24 and between the top body portion 12 and the bottom body portion 14 is the chamber 22. In other words, while the shim 33 spaces the top body portion 12 from the bottom body portion 14, it does not completely fill the space between the body portions 12 and 14, thereby creating the chamber 22 in the area that the shim 33 does not extend.

Figure 3:
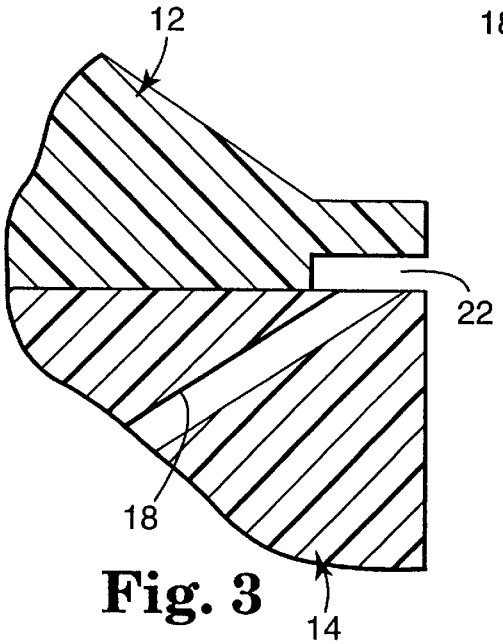
FIG. 3 is an cross-sectional view showing an alternative embodiment of a distribution chamber of a coating apparatus.
Figure 3A:
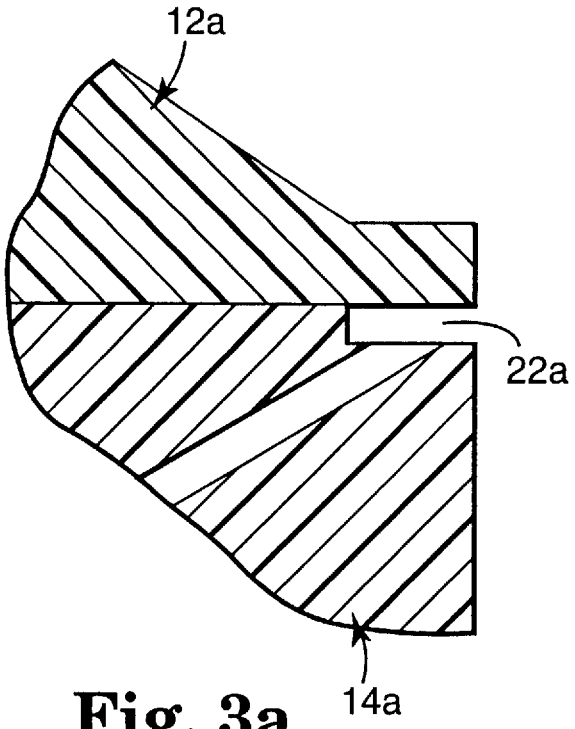
FIG. 3*a* is a cross-sectional view showing an alternative arrangement of a distribution chamber within a coating apparatus.
Figure 3B:
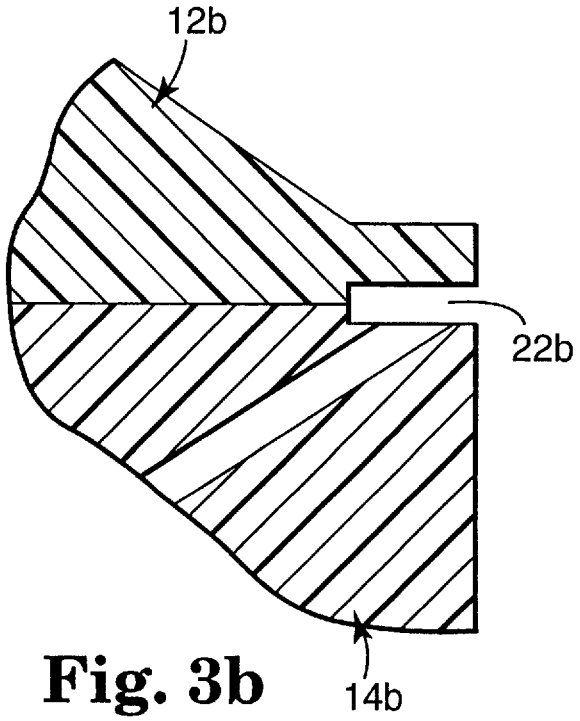
FIG. 3*b* is a cross-sectional view showing another alternative arrangement of a distribution chamber within a coating apparatus.

In another preferred embodiment, shown in FIG. 3, the distribution chamber 22 is cut from the top body portion 12, so that no shim is required to space the top body portion 12 from the bottom body portion 14 or to create the chamber 22. However, a shim 33 may be placed between the top body portion 12 and the bottom body portion 14 in order to make the chamber 22 larger. Alternatively, a distribution chamber 22*a* may be cut from a bottom body portion 14*a,* as shown in FIG. 3*a,* or a distribution chamber 22*b* may be cut from both top and bottom body portions 12*b,* 14*b,* as shown in FIG. 3*b*. In either of these alternatives, a shim 33 may be placed between the top body portion 12 and the bottom body portion 14 in order to increase the size of the chamber 22. Moreover, the apparatus or die 10 may comprise a single body portion with a distribution chamber cut from the single body portion (not shown), rather than comprising separate top and bottom body portions. In this embodiment, the size of the distribution chamber is not varied by the addition of shims.

Fluid flows through the distribution channels 18 and exits through the orifice openings 20 into the distribution chamber 22, where the fluid from each of the channels 18 can merge together into a generally continuous body of fluid. More specifically, the distribution chamber 22 has a first side 40 spaced inwardly from the smoothing surface 24 and a second side 42 that opens at the smoothing surface 24. As shown, the height H1 of the chamber 22 at the first side 40 preferably is substantially the same as the height H2 at the second side 42. The height H2 at the second side 42 is preferably in the range of 0.0025 cm (1 mil) to 0.127 cm (50 mils), although the height H2 may be either larger than 0.0025 cm or larger than 0.127 cm.

The orifice openings 20 are preferably positioned near the first side 40 of the distribution chamber 22 so that the individual fluid streams exiting the channels 18 can merge together into a substantially continuous stream of fluid in the distribution chamber 22 before the fluid stream reaches the second side 42 of the chamber 22.

Figure 4:
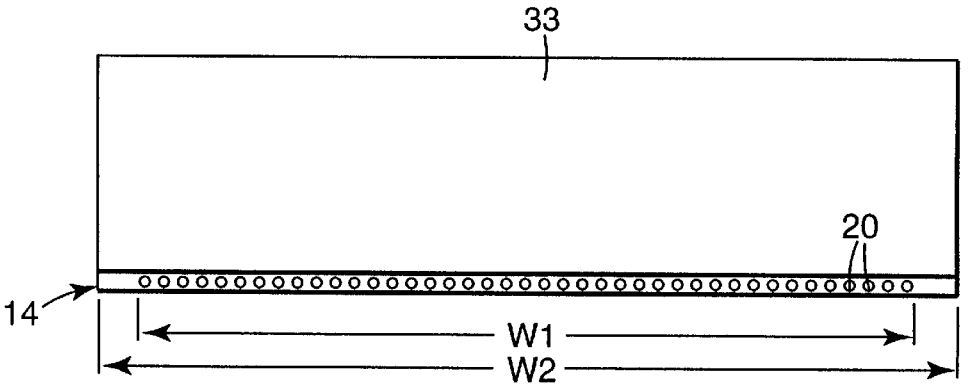
FIG. 4 is a plan view of a bottom body portion of a coating apparatus showing one arrangement of orifices.

As described above, the orifice openings 20 are either aligned in a single row or in a staggered or random arrangement along the length of the reservoir 16. The length of this row or other arrangement of orifice openings 20 is preferably equal to the width of the opening 42 of the distribution chamber, as shown in FIG. 1. Alternatively, the row of orifice openings 20 can have a width W1 that is shorter than the width W2 of the chamber 22, as illustrated in FIG. 4. Whether the width W1 of the row of orifice openings 20 is smaller than or approximately equal to the width W2 of the opening 42, the width W2 of the chamber 22 is an approximate limit of the coating width. However, the fluid may expand or spread out slightly due to the smoothing effect of the smoothing surface 24 on the fluid after the fluid is coated onto the substrate. This spreading of the fluid by the smoothing surface 24 depends at least partially on the viscosity of the fluid being coated and the coating weight of that fluid.

In some cases, the width WI of the row of orifice openings 20 will be smaller than the width W2 of the opening 42 so that the thickness of the fluid along the edges of the coating width will taper down to be thinnest at the edges of the coating width. This tapering of the coating material results because the pressure within the chamber 22 will be less in the areas without orifice openings 20 than in the areas having orifice openings 20. Therefore, the fluid will tend to move from the areas having orifice openings 20 to the areas without orifice openings.

Figure 5:
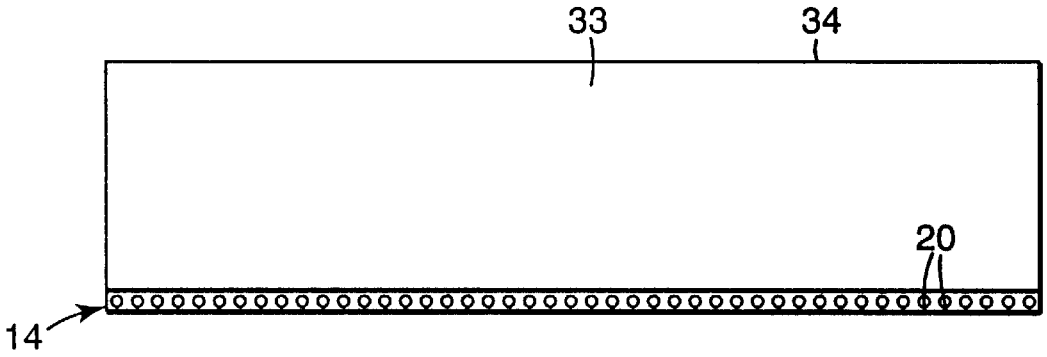
FIG. 5 is a plan view of a bottom body portion of a coating apparatus including a shim.
Figure 6:
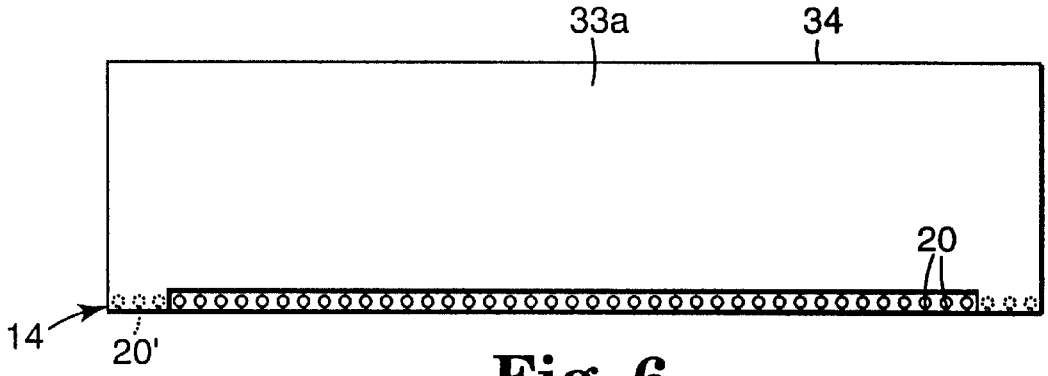
FIG. 6 is a plan view of a bottom body portion of a coating apparatus showing an alternative embodiment of a shim.

A shim 33 may be used to vary the width and pattern of the fluid being coated onto a substrate. In one preferred embodiment, shown in FIG. 5, the shim 33 does not block any of the orifice openings 20 so that the fluid is free to exit all of the orifice openings 20 into the chamber 22. To change the width of the fluid exiting the chamber 22 onto the substrate, however, a shim 33*a* may instead block a portion of the orifice openings 20, illustrated as blocked orifice openings 20' in FIG. 6. Since the fluid may only exit the unblocked orifice openings 20, the width of the fluid exiting the die 10 in FIG. 6 is less than the width of the fluid exiting the die 10 of FIG. 5. Therefore, a single die 10 may be used for a wide range of coating widths by using a shim 33 that limits the number of orifice openings 20 through which fluid may exit into the chamber 22.

Figure 7:
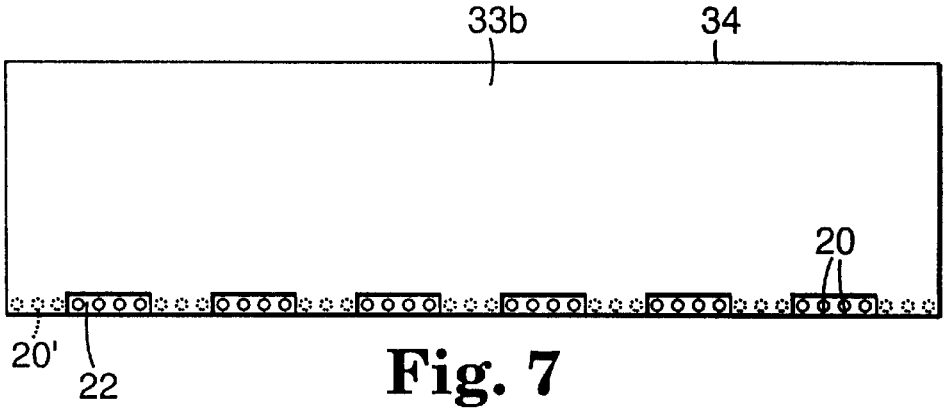
FIG. 7 is a plan view of a bottom body portion of a coating apparatus showing another alternative embodiment of a shim.

FIG. 7 illustrates another preferred embodiment, where a shim 33*b* blocks several different groups of orifice openings 20' along the width of the die 10. In this way, stripes of fluid will exit the chamber 22 in the areas of the unblocked orifice openings 20 onto the substrate, leaving portions of the substrate uncoated between the coated portions. It is understood that the number of coated and uncoated portions, along with the widths of those coated and uncoated portions, may vary widely depending on the design of the shim 33. In addition, in any embodiment where the orfices 20' are blocked by a shim, each blocked orifice 20' may either be entirely or partially blocked by the shim.

The die 10 is designed so that when the pressure within the chamber 22 increases, the fluid streams will merge with each other more easily than when the pressure in the chamber 22 is low. One way of varying the pressure within the chamber 22 is to design the die 10 so that the total cross-sectional area of all of the orifice openings 20 is greater than the cross-sectional area of the second side 42 of the chamber 22. As described above, the cross-sectional area of the second side 42 of the chamber 22 can be varied by changing the thickness of the shim 33 placed between the top body portion 12 and the bottom body portion 14, which thereby can change the fluid pressure within the chamber 22. If it is desirable to have a higher fluid pressure within the chamber 22, a thinner shim 33 may thus be inserted than when a lower fluid pressure is desired. Specifically, it is preferred that the shim 33 be selected so that the total cross-sectional area of all of the orifice openings 20 is between 2 and 10 times greater than the cross-sectional area of the second side 42 of the chamber. However, even if the cross-sectional area of the orifice openings 20 is less than the cross-sectional area of the second side 42 of the chamber 22, merging of the fluid streams will still take place within the chamber 22.

Another way of controlling the pressure within the chamber 22 is by the relative placement of the orifices 20 with respect to the smoothing surface 24. Spacing the orifices 20 further from the smoothing surface 24 typically causes the pressure in the distribution chamber 22' to increase. Conversely, spacing the orifices 20 closer to the smoothing surface 24 typically causes the pressure in the distribution chamber to decrease.

Figure 8:
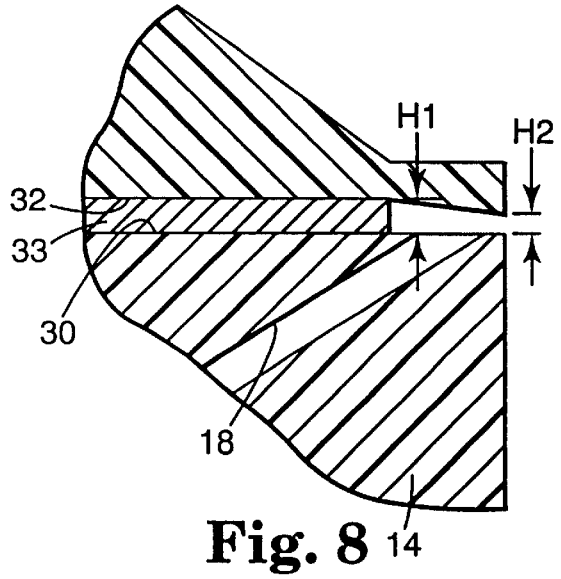
FIG. 8 is a cross-sectional view showing another alternative embodiment of a distribution chamber of a coating apparatus.

Another way to control the pressure within the chamber 22 is to change the shape of the chamber 22. For one example, shown in FIG. 8, the height H1 of the chamber 22 at the first side 40 may be larger than the height H2 at the second side 42, so that the chamber converges toward the smoothing surface 24. In this configuration, the decrease in the cross-sectional area of the chamber 22 when moving from the first side 40 of the chamber 22 to the second side 42 of the chamber 22 causes an increase in the pressure inside the distribution chamber 22.

The use of a shim 33 with the die 10 of the present invention is particularly beneficial for controlling the pressure within the chamber 22 so that a single coating die 10 may be used with fluids having widely varying viscosities and for coating a wide range of coating weights. A thicker shim 33 will typically be used for higher coating weights, since a thicker shim increases the size of the chamber 22, thereby increasing the amount of fluid that may exit the die 10. In addition, as the viscosity of the fluid increases, the pressure in the chamber 22 tends to increase. Thus, a thicker shim 33 may be used to control the pressure in the chamber 22 at an acceptably low level with high viscosity fluids. Conversely, when fluids having a low viscosity are being coated, such as fluids having a viscosity below 100 centipoise, a thinner shim 33 can be used.

After the fluid exits the second side 42 of the chamber 22, it is typically deposited onto a moving substrate as that substrate moves past the die 10. More specifically, the substrate preferably contacts the die 10 at some point on the lower body portion 14 below the chamber 22. The fluid exiting the chamber 22 is generally a uniform stream of fluid having a constant thickness across the width of the chamber 22. In these cases, the fluid requires very little smoothing by the smoothing surface 24. However, in some cases there may be slight ridges or bumps in the stream of fluid as it exits the chamber 22, where the fluid may be slightly thicker in the areas directly downstream from the orifice openings 20 than in the areas directly downstream from the spaces between the orifice openings 20. In these cases, the smoothing surface 24 is used to smooth the ridges or bumps in the fluid, thereby providing a smooth coating of fluid across the width of the substrate. Whether the fluid is uniform or if it has slight ridges or bumps, after is applied to the substrate from the chamber 22, the substrate contacts a first edge 46 of the smoothing surface 24, which smooths the fluid onto the substrate. As the substrate continues moving in the direction 26, it then contacts the second or knife edge 48 of the smoothing surface 24, which further smooths the fluid onto the substrate.

The height of the smoothing surface 24, which is equal to the distance between the first edge 46 and the knife edge 48, can effect the ability of the smoothing surface 24 to smooth the fluid onto the substrate. Specifically, a smoothing surface 24 having a certain height will typically apply a certain amount of pressure to the moving substrate as the substrate moves past the smoothing surface 24. Decreasing the height of this smoothing surface 24 increases the amount of energy per square unit of area applied to the substrate, and thereby increases the pressure applied to the substrate. This higher pressure applied to the substrate causes a corresponding increase in the smoothing effect on the fluid. Conversely, increasing the height of the smoothing surface 24 decreases the amount of energy per square unit of area applied to the substrate, and thereby decreases the pressure applied to the substrate. This lower pressure will thereby decrease the smoothing ability of the smoothing surface 24. The height of the smoothing surface 24 is preferably in the range of 0.013 cm (5 mils) to 2.54 cm (1 inch), and more preferably is in the range of 0.025 cm (10 mils) to 1.27 cm (0.5 inch).

The smoothing ability of the smoothing surface 24 is also effected by the viscosity of the fluid being coated onto the substrate. When lower viscosity fluids are being coated, less smoothing of the fluid may be necessary, therefore, a smoothing surface having a greater height may be beneficial. When higher viscosity fluids are being coated, more smoothing of the fluid may be necessary, therefore, a smoothing surface having a lesser height may be beneficial. However, it is understood that a single smoothing surface 24 having a particular height may be used with both high and low viscosity fluids.

Moreover, differing heights of the smoothing surface 24 may also provide for different fluid coating weights on the substrate. Specifically, if a fluid having a particular viscosity is being used and a high coating weight is desired, the length of the smoothing surface 24 should be greater than when a lower coating weight is desired.

Referring again to FIGS. 1 and 2, the top body portion 12, or cap, is preferably secured to the bottom body portion 14 with multiple bolts 50 spaced from the front of the die 10. In this way, the top body portion 12 is free to move with respect to the bottom body portion 14 at the smoothing surface 24. The top body portion 12 may be secured to the bottom body portion 14 by any known attachment means, such as bolts, screws, or the like. In this way, when the fluid pressure increases within the chamber 22, the opening at the second side 42 of the chamber 22 may expand or open uniformly across the width of the chamber 22. Alternatively, the top body portion 12 may be secured to the bottom body portion 14 across the front and/or sides of the die 10 so that the two body portions cannot freely move with respect to each other when the pressure within the chamber 22 increases. In this configuration, it is desirable to maintain the pressure within the chamber 22 at a level below that which would cause the top or bottom body portions 12, 14 to deflect or deform.

Figure 9:
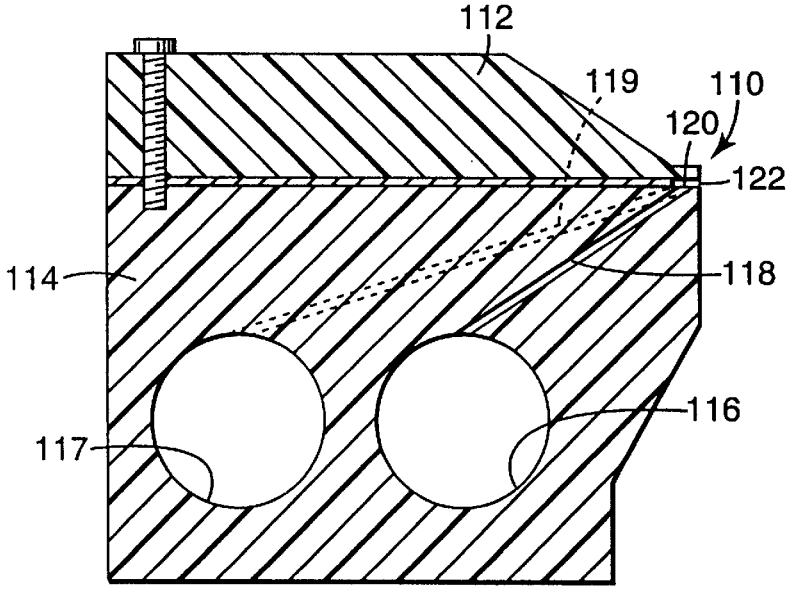
FIG. 9 is a cross-sectional view of another embodiment of a coating apparatus of the present invention showing two reservoirs.
Figure 10:
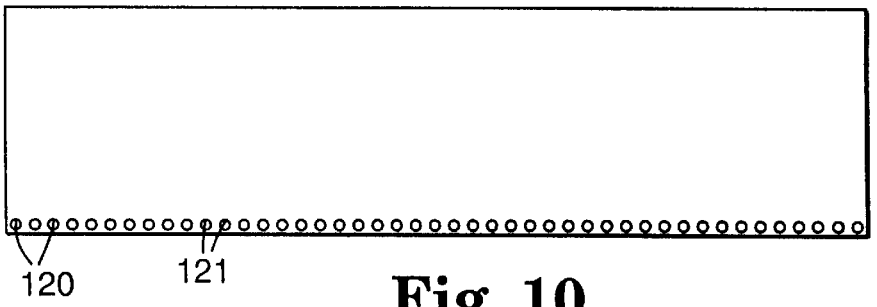
FIG. 10 is a plan view of a bottom body portion of the coating apparatus of FIG. 9.

FIG. 9 illustrates another preferred embodiment of the present invention. In this embodiment, the coating die 110 comprises a top body portion 112 and a bottom body portion 114. The bottom body portion 114 has two internal reservoirs 116 and 117 into which two fluids may enter the coating die. The fluids entering the reservoirs 116 and 117 may be the same or different fluids. The reservoir 116 has a plurality of distribution channels or nozzles 118 along the length of the reservoir 116 and extending therefrom in a generally upward direction. The reservoir 117 has a plurality of distribution channels or nozzles 119 along the length of the reservoir 117 and extending therefrom in a generally upward direction. As illustrated in FIG. 10, each channel 118 terminates at an orifice opening 120 and each channel 119 terminates at an orifice opening 121. The orifice openings 120 and 121 are positioned so that the fluid exiting the channels 118 and 119 exit into a distribution chamber 122.

The channels 118 and 119 may be positioned along the length of their respective reservoirs 116 and 117 to provide different arrangements of the orifices 120 and 121 in the chamber 122. For one example, channels 118 and 119 may alternate along the length of the die 110 so that the orifice openings 120 and 121 alternate along the length of the distribution chamber 122. In this way, the fluids exiting the orifice openings 120 and 121 can combine with each other in the distribution chamber 122 before exiting the die 110 to provide a uniform coating. For another example, several channels 118 may be grouped together and several channels 119 may be grouped together so that their corresponding orifice openings 120 and 121 will be in groups along the length of the chamber 122. In this way, fluid exiting the reservoir 116 can exit from the chamber 122 in stripes onto the substrate and fluid exiting the reservoir 117 can exit from the chamber 122 in stripes onto the substrate. These stripes may be positioned directly adjacent to each other, where the fluid exiting the orifices 120 may mix with the fluid exiting the orifices 121 at any point where the fluids contact each other. Alternatively, a shim may be used to provide uncoated portions between coated stripes.

Figure 11:
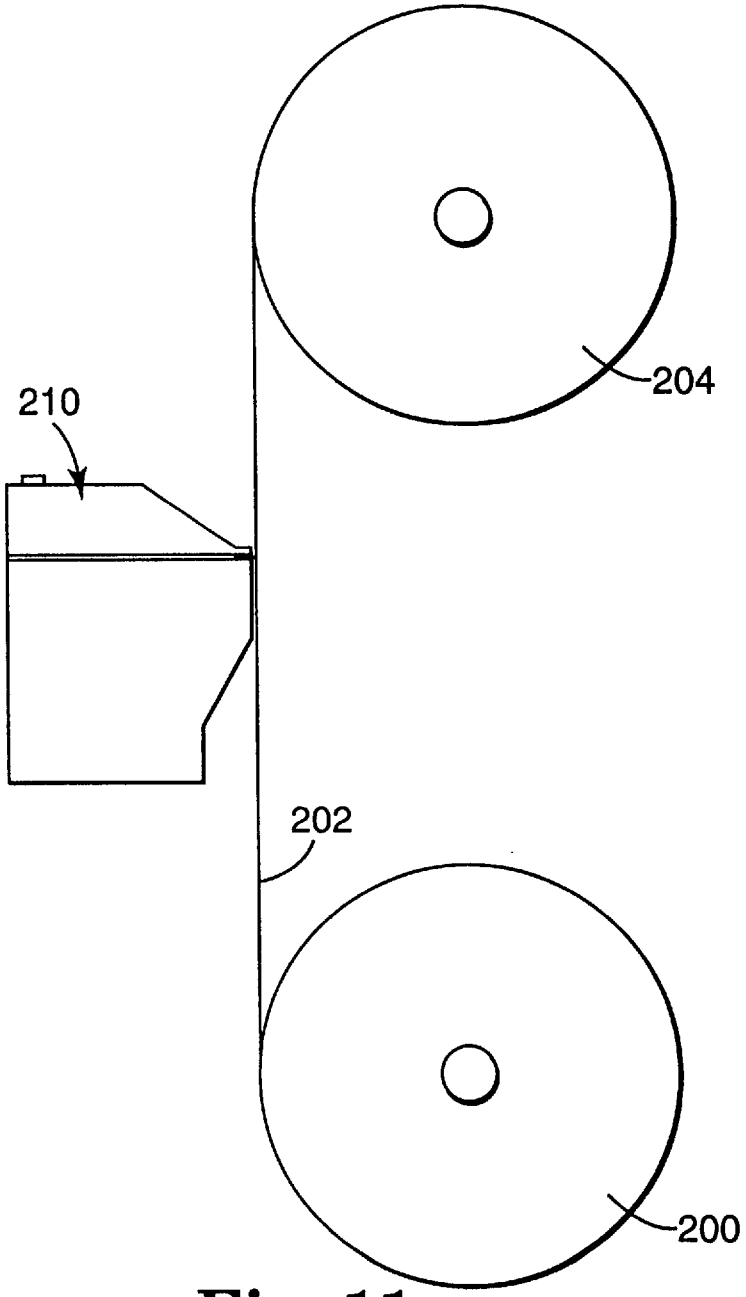
FIG. 11 is a schematic view illustrating one method of coating fluid onto a web according to the present invention.

The coating of at least one fluid onto the surface of a web material in accordance with the present invention will now be described in with reference to FIG. 11. Initially, a roll of material 200 is mounted on a support member so that a web of material 202 may be unwound from the roll. A coating apparatus or die 210 of the the present invention is, provided so that fluid may be coated onto the web of material 202 after it is unwound from the roll 200. Also provided is a means for conveying the web of material 202 past the coating die 210 and along a web path. Preferably, the conveying means comprises a driven roller, such as a roll 204 or series of driven rollers that pull the web of material from the roll 200 and past the coating die 210.

A pump or other apparatus is used to inject a quantity of the fluid into the reservoir of the coating die 210. The fluid injected into the reservoir is then conveyed by pressure from the reservoir and through the plurality of generally parallel fluid distribution channels toward the distribution chamber. Separate streams of fluid exit the distribution channels into the distribution chamber. As described above with reference to the coating die of the present invention, the pressure in the distribution chamber causes these separate fluid streams merge together in the chamber. After the fluid streams merge together, the fluid is ejected in a continuous stream from the second side of the distribution chamber. The fluid is then deposited on the web of material as it is conveyed past the second side of the distribution chamber. The fluid is then smoothed onto the web surface by an edge of the smoothing surface adjacent the distribution chamber. If desired, the fluid may be further smoothed, such as with a knife edge of the coating die 210 or some other smoothing surface spaced from the distribution chamber.

The operation of the present invention will be further described with regard to the following detailed examples. These examples are offered to further illustrate the various specific and preferred embodiments and techniques. It should be understood, however, that many variations and modifications may be made while remaining within the scope of the present invention. The equipment and process used for coating a web of material and the test procedure used to test the coated material were as follows:

Examples One and Two represent coating a web of material using similar coating apparatuses. However, Example One represents coating stripes of fluid across the width of a web of material while Example Two represents coating fluid in one continuous stream across the width of a web of material. The coating apparatus used for both Examples was generally of the type shown in FIG. 1.

For Example One, the reservoir of the coating apparatus was cylindrical in shape, having a diameter of 0.75 inches (1.91 cm) and a width of 49.5 inches (125.73 cm). The total width of the coating apparatus was 49.5 inches (125.73 cm). The fluid was supplied to the reservoir by a Zenith positive displacement gear pump operating at 100 cubic centimeters per revolution and 12 revolutions per minute. The distribution channels were cylindrical in shape, each having a diameter of 0.052 inches (0.132 cm), a length of approximately 1.125 inches (2.858 cm), and extending at an angle of 30 degrees from the reservoir. Each distribution channel was generally parallel to and spaced 0.056 inches (0.142 cm), center to center, from each adjacent distribution channel. Thus, there were approximately 17.857 distribution channels per linear inch (approximately 7.03 distribution channels per linear centimeter) and approximately 857 distribution channels across the total width of the coating apparatus. In addition, the smoothing surface was 0.062 inches (0.157) high and the edge of each of the orifice openings closest to the smoothing surface was spaced approximately 0.02 inches (0.051 cm) from the smoothing surface.

A shim was positioned between the top and bottom body portions to form the distribution chamber and was configured generally as is shown in FIG. 7. In Example One, this shim was configured to allow for four distribution chambers and for four stripes of material to be coated. In other words, four specific sections of orifices were left unblocked to allow fluid to exit from the distribution channels associated with those orifices and coat the four desired stripes, while the remaining orifices were blocked by the shim. The unblocked orifice sections were each 1.5 inches (3.81 cm) wide, which thereby left approximately 26.79 orifices unblocked in each section. The centerline of each of the stripes was spaced as follows from the left edge of the web material: first stripe, 2.06 inches (5.24 cm); second stripe, 22.75 inches (57.79 cm); third stripe, 26.06 inches (66.19 cm); and fourth stripe, 46.72 inches (118.67 cm). The shim was 0.007 inches (0.018 cm) thick and the depth of each distribution chamber was 0.135 inches (0.343 cm). Therefore, each distribution chamber was 0.007 inches (0.018 cm) high, 1.5 inches (3.81 cm) wide, and 0.135 inches (0.343 cm) deep.

For Example Two, the reservoir of the coating apparatus was cylindrical in shape, having a diameter of 0.75 inches (1.91 cm) and a width of 49.5 inches (125.73 cm). The total width of the coating apparatus was 49.5 inches (125.73 cm). The fluid was supplied to the reservoir by a Zenith positive displacement gear pump operating at 100 cubic centimeters per revolution and 39.8 revolutions per minute. The distribution channels were cylindrical in shape, each having a diameter of 0.052 inches (0.132 cm), a length of approximately 1.125 inches (2.858 cm), and extending at an angle of 30 degrees from the reservoir. Each distribution channel was generally parallel to and spaced 0.058 inches (0.147 cm), center to center, from each adjacent distribution channel. Thus, there were approximately 17.241 distribution channels per linear inch (approximately 6.79 distribution channels per linear centimeter) and approximately 530 distribution channels across the total width of the coating apparatus. In addition, the smoothing surface was 0.055 inches (0.139) high and the edge of each of the orifice openings closest to the smoothing surface was spaced approximately 0.05 inches (0.128 cm) from the smoothing surface.

Again, a shim was positioned between the top and bottom body portions to form the distribution chamber and was configured generally as is shown in FIG. 6, where sections of orifice openings were blocked by the shim on both ends of the distribution chamber, leaving a section of orifice openings unblocked in the center of the distribution chamber. The unblocked section of orifices was 30.75 inches (78.11 cm) wide. The shim was 0.007 inches (0.018 cm) thick and the depth of each distribution chamber was 0.150 inches (0.38 cm). Therefore, the distribution chamber was 0.007 inches (0.018 cm) high, 30.75 inches (78.11 cm) wide, and 0.150 inches (0.38 cm) deep.

In Example One, the fluid supplied to the reservoir to be coated was a solvent dispersed polymer having release properties, where the fluid was 12.5 percent solids and had a viscosity in the range of approximately 20 to 30 centipoise. The web material was a standard 15 pound bond paper that was 48.78 inches (123.90 cm) wide and was moved past the coating apparatus at 900 feet per minute (274.3 meters per minute). With these processing parameters, the wet coating weight applied to the web material was 0.005 pounds per square foot (0.0025 grams per square centimeter).

The fluid coated in Example Two was the same as that coated in Example One. The web material was a standard 15 pound bond paper that was 31.5 inches (80.01 cm) wide and was moved past the coating apparatus at 810 feet per minute (246.9 meters per minute). With these processing parameters, the wet coating weight applied to the web material was 0.0036 pounds per square foot (0.0018 grams per square centimeter).

After the fluids were coated onto the web materials, a peel test was used to measure peel adhesion values. Peel adhesion is the force required to remove a test tape from the coated web material as the test tape is pulled at a specific angle and a specific rate from the coated web material. For these tests, the test tape was #850 Adhesive Tape, commercially available from the Minnesota Mining and Manufacturing Company, St. Paul, Minn. In these tests, the required force is expressed in grams of adhesion per inch width of the test tape. The test procedure used was as follows.

A Deltron Ball Slide jig was inserted into the lower jaw of an Instron Tensile Tester and a six inch length of #9415 Double Coated Tape, commercially available from the Minnesota Mining and Manufacturing Company, was applied in the center of the jig. A four inch long section of the coated web material was placed onto this double coated tape, with the coated surface of the web material facing outward. A five inch long piece of the test tape was placed onto the surface of the coated web material and a 4.5 pound roller was then rolled across this configuration to secure the materials to each other. One end of the test tape was peeled from the coated web material and attached to the upper jaw of the Instron Tensile Tester so that the test tape was at an angle of 90 degrees to the coated material. The upper jaw of the tensile tester was then moved away from the bottom jaw at a rate of 12 inches per minute from the coated web material. The load cell of the tensile tester measured the force required to pull the test tape from the coated web material in grams. The peel adhesion was recorded as the average of the range of values observed during the test in grams per inch width of test tape.

THE RESULTS

The results of tests of Examples One and Two are tabulated below. In Example One, the position designated as 'Left' refers to the stripe closest to the left edge of the web material, the position designated as 'Center' refers to one of the two stripes closest to the center of the web material, and the position designated as 'Right' refers to the stripe closest to the right edge of the web material. Similarly, in Example Two, the positions designated as 'Left', 'Center', and 'Right' refer to samples taken from positions near the left edge, center, and right edge of the web material, respectively.

EXAMPLE ONE

| Test Number | Left | Center | Right |
|---|---|---|---|
| 1 | 5 | 4 | 4 |
| 2 | 5 | 3 | 4 |
| 3 | 5 | 2 | 4 |
| 4 | 3 | 4 | 4 |
| 5 | 11 | 6 | 9 |
| 6 | 8 | 6 | 9 |
| 7 | 4 | 4 | 4 |
| 8 | 7 | 4 | 4 |
| 9 | 5 | 4 | 5 |
| 10 | 12 | 5 | 4 |
| 11 | 7 | 5 | 5 |

EXAMPLE TWO

| Test Number | Left | Center | Right |
|---|---|---|---|
| 1 | 8 | 12 | 7 |
| 2 | 7.2 | 6.9 | 7.4 |
| 3 | 7.4 | 9.6 | 9.3 |
| 4 | 7.4 | 8.4 | 8.0 |
| 5 | 10.4 | 11 | 9.2 |
| 6 | 8.4 | 7.2 | 9.0 |
| 7 | 7.8 | 11 | 7.9 |
| 8 | 14.3 | 12.4 | 9.5 |
| 9 | 7.1 | 13.6 | 8.7 |
| 10 | 13.4 | 14.7 | 14.7 |

Lower peel adhesion values to the release coating indicate that the test tape is more likely to release from the release coating. Although there was some variability of the peel adhesion values to the release coating in both Examples, all values fell within a desired range of 1 to 15 grams of adhesion per inch width of the test tape. Further, the values were generally uniform across the width of the web.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

We claim:

1. An apparatus for applying a fluid to a moving web of material, comprising:

a body including a lower body portion, an upper body portion, and a reservoir having a cross-sectional area and adapted for receiving a quantity of the fluid;

a plurality of fluid distribution channels, the fluid distribution channels each having a length and a cross-sectional area and being in fluid communication with and extending in an unobstructed path from the reservoir from a first, proximate end and terminating at a second, distal end in an orifice, wherein the orifices of each of the channels are spaced in a row, wherein the cross-sectional area of each of the channels is substantially smaller than the cross-sectional area of the reservoir, and wherein the reservoir and plurality of distribution channels are enclosed within the lower body portion;

a distribution chamber in the body adapted for commonly receiving the fluid exiting each of the orifices, adapted for merging the fluid exiting each of the orifices into at least one continuous coating stream, and adapted for equalizing the pressure of the fluid, the distribution chamber having a first side and a second side, wherein the first side is in fluid communication with the plurality of fluid distribution channels and the second side is open to allow the fluid to exit the body for uniform distribution onto the web;

a smoothing surface on the body adjacent the second side of the distribution chamber adapted to smooth the fluid on the moving web as the fluid exits the second side of the distribution chamber and is deposited on the moving web; and a fluid supply means adapted for supplying fluid to the reservoir and adapted for maintaining the fluid under pressure in the reservoir, whereby the fluid moves under pressure from the reservoir along the unobstructed path through the fluid distribution channels to the first side of the distribution chamber, through the distribution chamber to exit the second side of the distribution chamber, and onto the moving web.

2. The apparatus of claim 1, further comprising a quantity of the fluid within the reservoir.

3. The apparatus of claim 2, wherein the fluid has a viscosity of less than 100 centipoise.

4. The apparatus of claim 1, wherein the reservoir includes a top portion and wherein the plurality of fluid distribution channels extend from the top portion of the reservoir in order to expel entrapped air within the reservoir.

5. The apparatus of claim 1, wherein the lower body portion has a top planar surface and the upper body portion has a bottom planar surface, wherein the top planar surface of the lower body portion contacts the bottom planar surface of the upper body portion.

6. The apparatus of claim 5, further including a gap spacing means between the upper and lower body portions, wherein the gap spacing means spaces the top planar surface of the lower body portion from the bottom planar surface of the upper body portion and defines the first side of the distribution chamber.

7. The apparatus of claim 6, wherein the gap spacing means extends at least partially into the distribution chamber.

8. The apparatus of claim 5, wherein the distribution chamber is formed in the upper body portion.

9. The apparatus of claim 5, wherein the distribution chamber is formed in the lower body portion.

10. The apparatus of claim 5, wherein the distribution chamber is formed in the upper and lower body portions.

11. The apparatus of claim 1, wherein the smoothing surface comprises a first edge adjacent the distribution chamber adapted to smooth the fluid on the web after the fluid exits the distribution chamber and a knife edge spaced from the distribution chamber adapted to further smooth the fluid on the web.

12. The apparatus of claim 1, wherein each of the plurality of fluid distribution channels has substantially the same length.

13. The apparatus of claim 1, wherein the length of at least one of the plurality of fluid distribution channels is greater then the length of at least one other of the plurality of fluid distribution channels.

14. The apparatus of claim 1, wherein the distribution chamber has a width and the row of orifices extends completely transversely across the width of the distribution chamber.

15. The apparatus of claim 1, wherein the second side of the distribution chamber has a cross-sectional area and wherein the cross-sectional area of the second side of the distribution chamber is less than a combined cross-sectional area of the orifices of the plurality of distribution channels, in order to provide sufficient pressure within the distribution chamber to allow the fluid exiting each of the orifices to combine into a uniform, continuous stream of fluid before the fluid exits the second side of the distribution chamber.

16. The apparatus of claim 15, wherein the combined cross-sectional area of the orifices is between 2 and 10 times greater than the cross-sectional area of the second side of the distribution chamber.

17. The apparatus of claim 1, wherein each of the orifices is spaced an equal distance from the second side of the distribution chamber.

18. The apparatus of claim 1, wherein each of the plurality of distribution channels is cylindrical and has a diameter in the range of 0.10 cm to 0.15 cm.

19. The apparatus of claim 1, wherein the smoothing surface has a height in the range of 0.013 cm and 2.54 cm.

20. The apparatus of claim 1, wherein the distribution chamber has a height in the range of 0.0025 cm and 0.127 cm.

21. The apparatus of claim 1, wherein each of the plurality of distribution channels extends from the reservoir at an angle in the range of 0 to 90 degrees.

22. An apparatus for applying a plurality of fluids to a moving web of material, comprising:

a body having a width and comprising a first reservoir adapted for receiving a quantity of a first fluid and a second reservoir adapted for receiving a quantity of a second fluid;

a first plurality of fluid distribution channels spaced from each other along the width of the body, the first plurality of fluid distribution channels each having a length and a cross-sectional area and being in fluid communication with and extending from the first reservoir from a first, proximate end and terminating at a second, distal end in an orifice;

a second plurality of fluid distribution channels spaced from each other along the width of the body, the second plurality of fluid distribution channels each having a length and a cross-sectional area and being in fluid communication with and extending from the second reservoir from a first, proximate end and terminating at a second, distal end in an orifice;

a distribution chamber in the body adapted for commonly receiving the plurality of fluids exiting each of the first and second plurality of orifices, adapted for merging the plurality of fluids exiting each of the first and second plurality of orifices into at least one continuous coating stream, and adapted for equalizing the pressure of the plurality of fluids, the distribution chamber having a first side and a second side, wherein the first side is in fluid communication with the first plurality of fluid distribution channels and the second plurality of fluid distribution channels and the second side is open to allow the plurality of fluids to exit the body for uniform distribution onto the web;

a smoothing surface on the body adjacent the second side of the distribution chamber adapted to smooth the plurality of fluids on the moving web as the plurality of fluids exit the second side of the distribution chamber and are deposited on the moving web; and at least one fluid supply means adapted for supplying the first fluid to the first reservoir, adapted for supplying the second fluid to the second reservoir, and adapted for maintaining the plurality of fluids under pressure in the first and second reservoirs, whereby the plurality of fluids move under pressure from the first and second reservoirs through the first and second plurality of fluid distribution channels, respectively, to the first side of the distribution chamber, through the distribution chamber to exit the second side of the distribution chamber, and onto the moving web.

23. The apparatus of claim 22, wherein the distribution chamber is divided into a plurality of discrete chambers, wherein a first discrete chamber is in fluid communication with the first plurality of fluid distribution channels and wherein a second discrete chamber is in fluid communication with the second plurality of fluid distribution channels.

24. The apparatus of claim 22, wherein the distribution chamber is divided into a plurality of discrete chambers, wherein a first discrete chamber is open on one side to allow the first fluid to exit the body in a first smooth coating of fluid and a second discrete chamber is open on one side to allow the second fluid to exit the body in a second smooth coating of fluid.

25. The apparatus of claim 24, wherein the first smooth coating of fluid is spaced from the second smooth coating of fluid.

26. The apparatus of claim 24, wherein the first smooth coating of fluid is adjacent to the second smooth coating of fluid.

27. The apparatus of claim 22, wherein the distribution chamber is adapted to receive and merge the first and second fluids as they exit the first and second plurality of distribution channels, respectively.

28. The apparatus of claim 22, further comprising a quantity of the first fluid within the first reservoir and a quantity of the second fluid within the second reservoir.

29. The apparatus of claim 28, wherein the first fluid and the second fluid each have a viscosity of less than 100 centipoise.

30. The apparatus of claim 22, wherein the first reservoir includes a top portion and wherein the first plurality of distribution channels extend from the top portion of the first reservoir in order to expel entrapped air within the first reservoir and wherein the second reservoir includes a top portion and wherein the second plurality of distribution channels extend from the top portion of the second reservoir in order to expel entrapped air within the second reservoir.

31. The apparatus of claim 22, wherein the body further includes a lower body portion having a top planar surface and an upper body portion having a bottom planar surface, wherein the top planar surface of the lower body portion contacts the bottom planar surface of the upper body portion.

32. The apparatus of claim 31, further including a gap spacing means between the upper and lower body portions, wherein the gap spacing means spaces the top planar surface of the lower body portion from the bottom planar surface of the upper body portion and defines the first side of the distribution chamber.

33. The apparatus of claim 32, wherein the gap spacing means extends at least partially into the distribution chamber.

34. The apparatus of claim 31, wherein the distribution chamber is formed in the upper body portion.

35. The apparatus of claim 31, wherein the distribution chamber is formed in the lower body portion.

36. The apparatus of claim 22, wherein the smoothing surface comprises a first edge adjacent the distribution chamber adapted to smooth the first and second fluids on the web after the first and second fluids exit the distribution chamber and a knife edge spaced from the distribution chamber adapted to further smooth the first and second fluids on the web.

37. The apparatus of claim 22, wherein the second side of the distribution chamber has a cross-sectional area and wherein the cross-sectional area of the second side of the distribution chamber is less than a combined cross-sectional area of the orifices of the first plurality of distribution channels and the orifices of the second plurality of distribution channels, in order to provide sufficient pressure within the distribution chamber to allow the first fluid exiting the orifices of the first plurality of distribution channels and the second fluid exiting the orifices of the second plurality of distribution channels to combine into at least one uniform, continuous stream of fluid before the first fluid and the second fluid exit the second side of the distribution chamber.

38. An apparatus for applying a fluid to a moving web of material, comprising:

a body including a reservoir having a cross-sectional area and adapted for receiving a quantity of the fluid, a lower body portion having a top planar surface and a bottom surface, and an upper body portion having a top surface and a bottom planar surface, wherein the top planar surface of the lower body portion contacts the bottom planar surface of the upper body portion, and wherein the reservoir includes a top portion;

a gap adjustment spacing means between the upper and lower body portions, wherein the gap adjustment spacing means spaces the top planar surface of the lower body portion from the bottom planar surface of the upper body portion;

a plurality of fluid distribution channels, the fluid distribution channels each having a length and a cross-sectional area and being in fluid communication with and extending in an unobstructed path from the reservoir from a first, proximate end and terminating at a second, distal end in an orifice, wherein the orifices of each of the channels are spaced in a row, and wherein the cross-sectional area of each of the channels is substantially smaller than the cross-sectional area of the reservoir, and wherein the reservoir and plurality of distribution channels are enclosed within the lower body portion;

a distribution chamber in the body adapted for commonly receiving the fluid exiting each of the orifices, adapted for merging the fluid exiting each of the orifices into at least one continuous coating stream, and adapted for equalizing the pressure of the fluid, the distribution chamber having a first side and a second side, wherein the first side is in fluid communication with the plurality of fluid distribution channels and the second side is open to allow the fluid to exit the body for uniform distribution onto the web;

a smoothing surface on the body adjacent the second side of the distribution chamber adapted to smooth the fluid on the moving web as the fluid exits the second side of the distribution chamber and is deposited on the moving web; and a pump adapted for supplying fluid to the reservoir and adapted for maintaining the fluid under pressure in the reservoir, whereby the fluid moves under pressure from the reservoir along the unobstructed path through the fluid distribution channels to the first side of the distribution chamber, through the distribution chamber to exit the second side of the distribution chamber, and onto the moving web.

39. The apparatus of claim 7, wherein the distribution chamber further comprises a first end and a second end opposite the first end in a transverse direction of the chamber, and wherein the gap spacing means comprises at least one flange extending into the distribution chamber and covering at least one of the orifices.

40. The apparatus of claim 39, wherein the gap spacing means further comprises a first flange adjacent the first end of the chamber and covering the orifices in the body portion adjacent the first flange, and a second flange adjacent the second end of the chamber and covering the orifices in the body portion adjacent the second flange adapted to adjust a width of fluid exiting the body.

41. The apparatus of claim 40, wherein the gap spacing means further comprises at least one intermediate flange positioned between the first and second flanges and covering the orifices in the body portion adjacent the intermediate flange to divide the chamber into a plurality of discrete chambers.

42. An apparatus for applying a fluid to a moving web of material, comprising:

a body including a lower body portion, an upper body portion, and a reservoir having a cross-sectional area and adapted for receiving a quantity of the fluid;

a quantity of fluid within the reservoir, wherein the fluid has a viscosity of less than 100 centipoise;

a plurality of fluid distribution channels, the fluid distribution channels each having a length and a cross-sectional area and being in fluid communication with and extending in an unobstructed path from the reservoir at an angle in the range of 0 to 90 degrees from a first, proximate end and terminating at a second, distal end in an orifice, wherein the orifices of each of the channels are spaced in a row, wherein each of the channels is cylindrical and has a diameter in the range of 0.10 cm to 0.15 cm, and wherein the cross-sectional area of each of the channels is substantially smaller than the cross-sectional area of the reservoir, and wherein the reservoir and plurality of distribution channels are enclosed within the lower body portion;

a distribution chamber in the body adapted for commonly receiving the fluid exiting each of the orifices, adapted for merging the fluid exiting each of the orifices into at least one continuous coating stream, and adapted for equalizing the pressure of the fluid, the distribution chamber having a first side and a second side, wherein the first side is in fluid communication with the plurality of fluid distribution channels and the second side is open to allow the fluid to exit the body for uniform distribution onto the web, and wherein the distribution chamber has a height in the range of 0.0025 cm and 0.127 cm;

a smoothing surface on the body adjacent the second side of the distribution chamber adapted to smooth the fluid on the moving web as the fluid exits the second side of the distribution chamber and is deposited on the moving web, the smoothing surface having a height in the range of 0.013 cm and 2.54 cm; and a fluid supply means adapted for supplying fluid to the reservoir and adapted for maintaining the fluid under pressure in the reservoir, whereby the fluid moves under pressure from the reservoir through the fluid distribution channels to the first side of the distribution chamber, through the distribution chamber to exit the second side of the distribution chamber, and onto the moving web.

43. The apparatus of claim 1, wherein the distribution chamber has a height and a width and wherein the apparatus further comprises attachment means adapted for securing the upper body portion to the lower body portion, wherein the attachment means allows the upper body portion to move relative to the lower body portion to uniformly change the height of the chamber across the chamber width.

* * * * *